US006820361B2

(12) United States Patent
Popikow

(10) Patent No.: US 6,820,361 B2
(45) Date of Patent: Nov. 23, 2004

(54) BREAK-ACTION FIREARM

(75) Inventor: Sergej Popikow, Weitnau (DE)

(73) Assignee: S.A.T. Swiss Arms Technology AG, Neuhausen (CH)

( * ) Notice: Subject to any disclaimer, the term of this patent is extended or adjusted under 35 U.S.C. 154(b) by 0 days.

(21) Appl. No.: 10/612,714

(22) Filed: Jul. 2, 2003

(65) Prior Publication Data

US 2004/0144008 A1 Jul. 29, 2004

(30) Foreign Application Priority Data

Aug. 2, 2002 (DE) ..... 102 35 283

(51) Int. Cl.[7] ..... F41A 3/58
(52) U.S. Cl. ..... 42/44; 42/40
(58) Field of Search ..... 42/40, 44, 45

(56) References Cited

U.S. PATENT DOCUMENTS 2,603,021 A * 7/1952 Marcel ..... 42/43
4,282,671 A 8/1981 Wood et al.
5,469,649 A * 11/1995 Rowlands et al. ..... 42/43

FOREIGN PATENT DOCUMENTS

DE 229 521 * 12/1910 ..... 42/44
DE 44 22 895 C1 10/1995
DE 199 09 114 C1 10/2000

* cited by examiner

*Primary Examiner*—Stephen M. Johnson
(74) *Attorney, Agent, or Firm*—Martin Fleit; Paul D. Bianco; Fleit Kain Gibbons Gutman Bongini & Bianco P.L.

(57) ABSTRACT

A break-action firearm with a breech housing, a barrel section that can pivot about a hinge bearing on the breech housing, and a removable fore-end, which contains on its front end a locking mechanism and on its rear end a bearing section for pivoting connection to the breech housing. This provides an easy-to-manufacture fore-end of the break-action firearm with minimal overall height, such that the hinge bearing grasps hinge pin, which project laterally inwards from the breech housing and which engage in lateral recesses on opposing side surfaces of a fastener section of the barrel section. In addition, the bearing section has bolts, which project inwards with at least one lateral contact surface and which lead to contact on corresponding abutment surfaces on the two side surfaces of the fastener section.

8 Claims, 2 Drawing Sheets

BREAK-ACTION FIREARM

BACKGROUND OF THE INVENTION

1. Field of the Invention

The invention relates to a novel break-action firearm

1. Prior Art

A break-action firearm is known from German Published Application No. DE 44 22 895 C1. In this publication, the hinge bearing for pivoting the barrel section of the firearm consists of a continuous hinge bolt, which extends underneath the two barrels perpendicular through the breech housing. The hinge bolt is gripped by the bearing box, which is composed of two halves, one half that is open to the front on a front barrel catch of a fastener section extending downwards and one half that is open to the rear of a bearing section that is attached to the rear end of the fore-end of the stock. To lock the barrel section relative to the breech housing, on the fastener section there is also a rear barrel catch that engages a slide that can be activated by a locking lever. At its front end, the fastener section also has an additional tab, which projects downwards and which acts as an abutment for a screw arranged in the fore-end of the stock. At the front end of the fore-end of the stock there is a locking mechanism, by means of which the fore-end of the stock can be locked to a lug of the barrel section. When the fore end of the stock is locked to the barrel section, the engagement between the screw and the tab acts so that the two halves of the bearing box grasp the hinge bolt with a predetermined pressure. However, for such a break-action firearm, the production of the fastener section with the two-barrel catches and the additional tab is relatively complicated. In addition, the fastener section exhibits a correspondingly high overall height due to its parts interacting with the underlying hinge bolt.

Another break-action firearm with a removable fore-end of the stock is known from U.S. Pat. No. 4,282,671. In this publication, at its rear end, the fore-end of the stock has a bearing box with a convex bearing surface for contact on a concave counter surface at the front end of a breech housing. For play-free contact of the bearing box on the breech housing, in the middle of the fore-end of the stock there is a recess with an adjustable wedge slide. This wedge slide engages a wedge piece, which is attached to the bottom side of the barrel. Through corresponding adjustment of the wedge slide, the fore-end of the stock is pressed with its rear bearing box against the convex counter surface of the breech housing. For this configuration, however, the wedge piece attached to the barrel must absorb relatively large forces when the fore-end of the stock is braced due to the wedge effect, and thus, the wedge piece is attached to the barrel through hard soldering. However, the heat produced in this process can negatively affect the properties of the heat-treated barrels, which requires expensive post processing.

A break-action firearm is also known from German Published Application No. DE 199 09 114 C1, which contains a barrel fastener section that can pivot about a hinge bearing on the breech housing and a removable fore-end of the stock. The fore-end of the stock has in the region of its rear end one half of the bearing box, which is open to the rear and which, together with a bearing box half that is open to the front on the barrel fastener section, grips a continuous hinge bolt forming the hinge joint on the breech housing. The barrel fastener section also has a tab, which points downwards and which forms an abutment for a stop on the fore-end of the stock. At the fore-end of the stock there is an adapter sleeve, which is supported on a diagonal abutment surface of the tab when the break-action firearm is assembled and which provides contact pressure of the two bearing box halves against the hinge bolt.

SUMMARY OF THE INVENTION

The object of the invention is to provide a novel break-action firearm of the type mentioned in the foregoing discussion, which features a fore-end of the stock that is easy to manufacture with a low overall height.

This object is accomplished by a novel break-action firearm with a breech housing, a barrel section that can pivot about a hinge bearing on the breech housing, and a removable fore-end, which contains on its front end a locking mechanism and on its rear end a bearing section for pivoting connection to the breech housing. This provides an easy-to-manufacture fore-end of the break-action firearm with minimal overall height, such that the hinge bearing grasps hinge pin, which project laterally inwards from the breech housing and which engage in lateral recesses on opposing side surfaces of a fastener section of the barrel section. In addition, the bearing section has bolts, which project inwards with at least one lateral contact surface and which lead to contact on corresponding abutment surfaces on the two side surfaces of the fastener section.

The invention further contemplates that in a break-action firearm with a breech housing, a barrel section that can tilt about a hinge bearing on the breech housing, and a removable fore-end, which contains on its front end a locking mechanism and on its rear end a bearing section for pivoting connection to the breech housing, there is the improvement comprising the hinge bearing grasping hinge pins, which project laterally inwards from the breech housing and which engage in lateral recesses on opposing side surfaces of a fastener section of the barrel section, and the bearing section has bolts, which project inwards with at least one lateral side surface and which lead to contact on corresponding abutment surfaces on the two side surfaces of the fastener section.

Further features of the invention include the improvement wherein the bolts are arranged in two side cross pieces of the bearing section overlapping the side surfaces of the fastener section; the improvement wherein the bearing section has rear, concave bearing surfaces for contact to corresponding convex counter surfaces on the front end of the breech housing; the improvement wherein the bolts can rotate and are securely held on the bearing section so that they cannot fall out; the improvement wherein the bolts can rotate due to a radial groove provided in the bolts and a cross pin arranged in the cross pieces and are securely held on the bearing section so that they cannot fall out; the improvement wherein the abutment surfaces are arranged on the two side surfaces of the fastener section above the recesses for the hinge pin; the improvement wherein the abutment surfaces are arranged on the front side of two guidance grooves on the two side surfaces of the fastener section; and the improvement wherein the bolts have at least two opposing contact surfaces with different distances to the center axis of the bolt.

For the break-action firearm according to the invention, the barrel section can pivot about two hinge pins, which project inwards in the breech housing and which engage lateral recesses on opposing side surfaces of a fastener section. The bearing section of the fore-end connected to the breech housing so that it can pivot has bolts, which project inwards with at least one lateral contact surface and which contact corresponding abutment surfaces on the two side surfaces of the fastener section for a stacked fore-end. Through corresponding selection of the simple-to-exchange bolts, the contact pressure of the fastener section can thus be adjusted to the hinge pin and if necessary, quickly and easily corrected. If, e.g., the play on the hinge joint is too large or too small, the bolts can be removed in a simple way and replaced by bolts for which the distance of the contact surface to the bolt center point is correspondingly greater or smaller. Due to the lateral bolts, system forces acting on the fore-end are supported by the fastener section. Therefore, the locking mechanism should not receive large forces, so that the mountings attached on the barrel can be attached, e.g., through soft soldering, without a great heating effect. Thus, negative effects on the barrels can be avoided. Both the two hinge pins and also the bolts are arranged at the level of the bottom barrel, which enables a minimal overall height and compact construction of the firearm fore-end.

In a preferred configuration of the invention, the bolts have at least two opposing contact surfaces at different distances to the center axis of the bolt. Thus, different contact forces can be realized with one bolt through a corresponding rotation.

Additional details and advantages of the invention will become apparent from the following detailed description of preferred embodiments when taken in conjunction with the drawings.

BRIEF DESCRIPTION OF THE DRAWINGS

Referring to the drawings.

DETAILED DESCRIPTION OF PREFERRED EMBODIMENTS OF THE INVENTION

Figure 1:
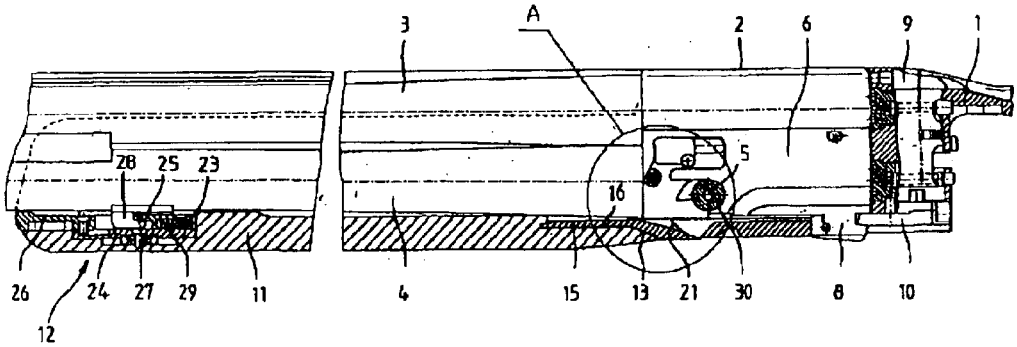
FIG. 1 shows in a partially cut-away side view a part of a double-barrel break-action firearm with fastener section and fore-end.

The break-action firearm shown partially in FIG. 1 contains a breech block 1, shown only partially, on which a barrel section with a fastener section 2 and an upper and lower barrel 3 and 4 are arranged so that they can pivot about an axis of rotation 5. The fastener section 2 has two opposing side surfaces 6 and 7 as well as a lower barrel catch 8, which engages in a corresponding receptacle opening of the breech block 1 and can be locked or released by a locking wedge 10 that can be activated by means of a locking lever 9. The break-action firearm further contains a (not illustrated) rear stock and fore-end 11, which has at its front end a locking mechanism 12 and at its rear end a bearing section 13 shown by itself in FIGS. 5 and 6.

Figure 6:
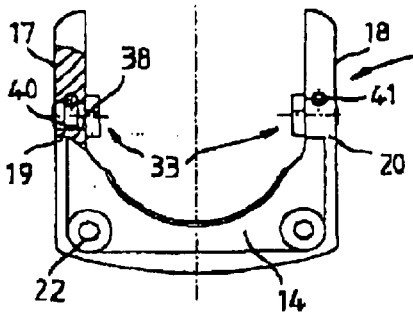
FIG. 6 shows in a rear view the bearing section of FIG. 5.
Figure 5:
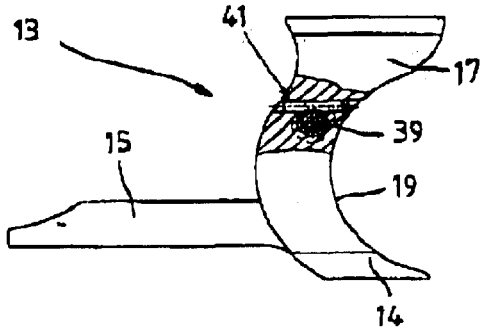
FIG. 5 shows in a side view a bearing section of a fore-end.

As follows from FIGS. 5 and 6, the bearing section 13 composed of metal contains a rear contact section 14 and a lug 15, which projects forwards and which is arranged in a recess 16 shown in FIG. 1 at the rear end of the fore-end 11. The essentially U-shaped contact section 14 in the rear view of FIG. 6 has two cross pieces 17 and 18, which overlap the side surfaces 6 and 7 of the fastener section 2 and which have on their rear side concave bearing surfaces 19 and 20 for contact to the corresponding convex counter surfaces 21 at the front end of the breech housing 1. In the contact section 14, there are two end-side holes 22 for attaching the bearing section 13 to the fore-end 11.

The locking mechanism 12 arranged at the front end of the fore-end 11 contains a guidance section 24 attached in a recess 23 on the fore-end 11, on which a slide 26 with a wedge 25 is arranged so that it can move parallel to the barrel axis. The wedge 25 engages in a groove 27 of a barrel lug 28 attached on the lower barrel 4. Between the guidance section 24 and the slide 26, there is a spring 29, by means of which the wedge 25 is pressed into the groove 27. By pushing back the slide 26 against the force of the spring 29, the wedge 25 can be disengaged from the groove 27 and the fore-end 11 can be tipped downwards at the front end.

To rotate the fastener section 2 about the axis of rotation 5, two opposing hinge pins 30 projecting inwards are arranged at the sides of the breech block 1. These hinge pins engage in side recesses 31 on opposing side surfaces 6 and 7 of the fastener section 2. The two recesses 31 have a rear semicircular contact surface 32, which forms a bearing surface open to the front for contact of the fastener section 2 on the corresponding hinge pin 30. By means of the two concave contact surfaces 19 and 20 contacting the convex counter surfaces 21 of the breech block, a bearing surface open to the rear is formed for the tilting motion of the barrel section 2 for opening and closing the breech. The contact pressure of the contact surfaces 19 and 20 of the bearing section 13 on the counter surfaces 21 of the breech block 1 is realized through two opposing bolts 33, which project inwards from the cross pieces 17 and 18 of the bearing section 13 and which according to FIG. 2 lead to contact on diagonal abutment surfaces 35 at the two side surfaces 6 and 7 of the fastener section 2 with a side surface 34. The contact pressure can be set through suitable selection of the distance a of the contact surface 34 from the center point of the bolt 33. This contact pressure is the pressure, with which the fastener section 2 is pressed to the two hinge pins 30 and the bearing section 13 with its contact surfaces 19 and 20 is pressed to the counter surfaces 21.

Figure 2:
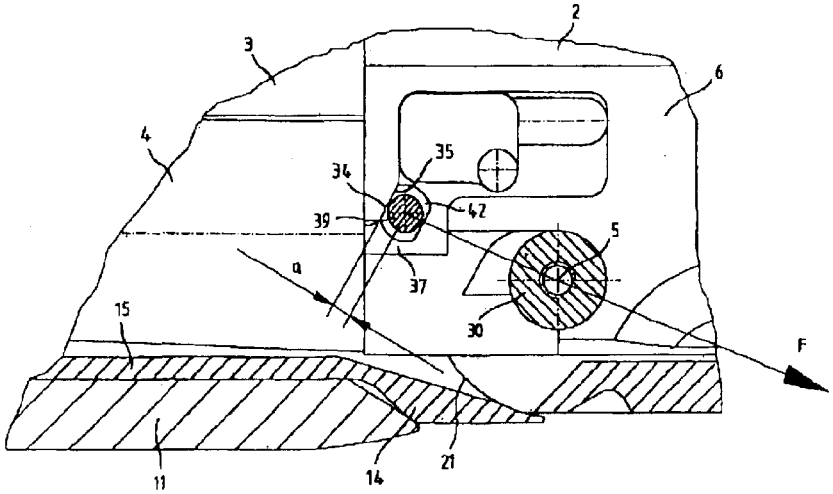
FIG. 2 is a detailed view of region A of FIG. 1.
Figure 4:
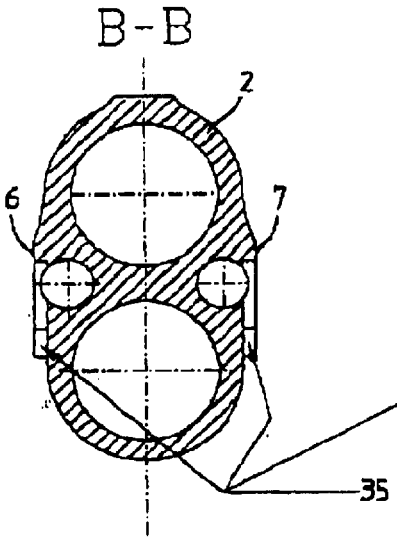
FIG. 4 is a sectional view of the fastener section taken along the line B—B of FIG. 3.
Figure 3:
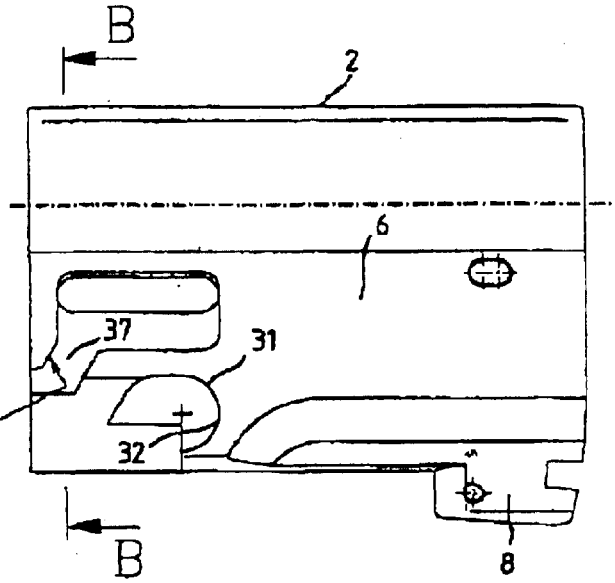
FIG. 3 is a detail view showing the fastener section of the break-action firearm of FIG. 1.

The diagonal abutment surfaces 35 for the two bolts 33 are located at the front side of two guidance grooves 37, which are arranged on the two side surfaces 6 and 7 of the fastener section 2 above the recesses 31 for the hinge pin 30. The abutment surfaces 35 pointing backwards are inclined diagonally downwards, so that a force F on the hinge pins 30 in the direction of the arrow according to FIG. 2 is generated by the bolts 33.

Figure 8:
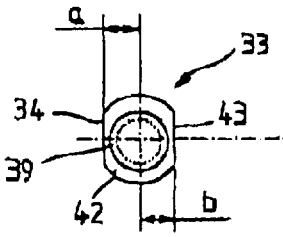
FIG. 8 shows in a front view the bolt of FIG. 7.
Figure 7:
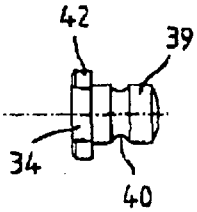
FIG. 7 shows in a side view a bolt of the bearing section of FIG. 6.

As follows from FIGS. 5 and 6, opposing holes 38 for the two bolts 33 are arranged in the two cross pieces 17 and 18 of the bearing section 12. The bolts 33 with one shown by itself in FIGS. 7 and 8 are arranged over a narrow pin 39 so that they can rotate in holes 38. The pin 39 contains a circular groove 40, through which the bolt 33 is securely held against the contact section 14 by means of a cross pin 41 so that the bolt does not fall out. The side contact surface 34 and another opposite surface 43 are provided on a wide contact section 42 of the bolt 33 projecting inwards from the cross piece 15 or 16.

As shown in FIG. 8, the two opposite surfaces 34 and 43 feature different distances a and b from the center point of the bolt 33. By rotating the bolt 33, the contact pressure of the fastener section 2 to the two hinge pins 30 can be changed when necessary. If the distances preset by the existing bolts are not adequate, the bolts can be replaced in a simple way by bolts exhibiting other distances of the contact surfaces 34 and 43 from the bolt center point.

To assemble the previously described break-action firearm, initially the fastener section 2 with the two barrels 3 and 4 is inserted on the breech housing 1, so that the fastener section 2 contacts the two hinge pins 30 with its two contact surfaces 32 from behind. Then the fore-end 11 with its rear bearing section 13 can be set in a downwards tilted position on the breech housing 1 and pivoted upwards such that the bolt 33 projecting on the inner side of the bearing section 13 contacts the abutment surfaces 35 of the fastener section 2 with its contact surface 34. The bolts 33 rotate so that their contact surfaces 34 can contact the abutment surface 35 for attaching and pivoting the fore-end 11 upwards. If the fore-end 11 is pivoted upwards, the catch 25 of the spring-loaded slide 26 locks in the groove 27 of the barrel lug 28, which holds the fore-end 11 in a locked position. To disassemble the barrel section, the slide 26 merely has to be pushed back by hand, which releases the locking mechanism and allows the fore-end 11 to be pivoted downwards and removed. Then the barrel section can also be unhinged.

Although the invention has been shown and described in specific terms, nevertheless changes and modifications will be apparent to those skilled in the art, which do not depart from the spirit, scope and teachings of the invention. Such changes and modifications are deemed to fall within the purview of the invention as claimed.

What is claimed is:

1. In a break-action firearm with a breech housing, a barrel section that can tilt about a hinge bearing on the breech housing, and a removable fore-end, which contains on its front end a locking mechanism and on its rear end a bearing section for pivoting connection to the breech housing, the improvement comprising the hinge bearing grasping hinge pins, which project laterally inwards from the breech housing and which engage in lateral recesses on opposing side surfaces of a fastener section of the barrel section, and the bearing section has bolts, which project inwards with at least one lateral side surface and which lead to contact on corresponding abutment surfaces on the two side surfaces of the fastener section.

2. In a break-action firearm according to claim 1, the improvement wherein the bolts are arranged in two side cross pieces of the bearing section overlapping the side surfaces of the fastener section.

3. In a break-action firearm according to claim 1, the improvement wherein the bearing section has rear, concave bearing surfaces for contact to corresponding convex counter surfaces on the front end of the breech housing.

4. In a break-action firearm according to claim 1, the improvement wherein the bolts can rotate and are securely held on the bearing section so that they cannot fall out.

5. In a break-action firearm according to claim 2, the improvement wherein the bolts can rotate due to a radial groove provided in the bolts and a cross pin arranged in the cross pieces and are securely held on the bearing section so that they cannot fall out.

6. In a break-action firearm according to claim 1, the improvement wherein the abutment surfaces are arranged on the two side surfaces of the fastener section above the recesses for the hinge pin.

7. In a break-action firearm according to claim 1, the improvement wherein the abutment surfaces are arranged on the front side of two guidance grooves on the two side surfaces of the fastener section.

8. In a break-action firearm according to claim 1, the improvement wherein the bolts have at least two opposing contact surfaces with different distances to the center axis of the bolt.

* * * * *